US007558510B2

(12) United States Patent
Iwasaki

(10) Patent No.: US 7,558,510 B2
(45) Date of Patent: Jul. 7, 2009

(54) IMAGE FORMING APPARATUS INCLUDING A PHASE ADJUSTING UNIT FOR ADJUSTING THE PHASE OF ROTATIONAL FLUCTUATION OF IMAGE CARRIERS AND METHOD FOR CONTROLLING THE SAME

(75) Inventor: Hiroyuki Iwasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 380 days.

(21) Appl. No.: 11/519,059

(22) Filed: Sep. 12, 2006

(65) Prior Publication Data

US 2007/0059041 A1 Mar. 15, 2007

(30) Foreign Application Priority Data

Sep. 13, 2005 (JP) ..... 2005-265663

(51) Int. Cl.
*G03G 15/00* (2006.01)
*G03G 15/01* (2006.01)

(52) U.S. Cl. ..... 399/167; 399/301

(58) Field of Classification Search ..... 399/167, 399/301, 299, 302
See application file for complete search history.

(56) References Cited

U.S. PATENT DOCUMENTS 5,881,346 A * 3/1999 Mori et al. ..... 399/301
6,937,836 B2 * 8/2005 Wasai ..... 399/301
7,054,586 B2 5/2006 Kuroda
7,239,833 B2 * 7/2007 Tomita et al. ..... 399/299
2002/0003973 A1 * 1/2002 Saito ..... 399/167
2005/0047834 A1 * 3/2005 Tomita et al. ..... 399/301
2005/0058470 A1 3/2005 Funamoto et al.
2005/0195235 A1 * 9/2005 Kitao
2005/0235652 A1 * 10/2005 Iwasaki
2006/0002745 A1 1/2006 Iwasaki
2006/0133862 A1 6/2006 Kuroda
2007/0127830 A1 * 6/2007 Hanami
2007/0196132 A1 * 8/2007 Kobayashi et al. ..... 399/167

FOREIGN PATENT DOCUMENTS

EP 1 345 088 A1 9/2003
JP 03-138566 6/1991
JP 09-127755 5/1997
JP 2002-268315 9/2002

OTHER PUBLICATIONS

European Search Report dated Nov. 22, 2006 for corresponding application No. 06120431.9.

* cited by examiner

*Primary Examiner*—Susan S Lee
(74) *Attorney, Agent, or Firm*—Harness, Dickey & Pierce, P.L.C.

(57) ABSTRACT

An image forming apparatus includes a plurality of image carriers, a driving unit that rotationally drives the image carriers in an individual manner, and a phase adjusting unit that adjusts, based on a reference rotation position on one of the image carriers, phase of rotational fluctuation of the other image carrier per one rotation.

8 Claims, 10 Drawing Sheets

FIG. 10

$$\begin{bmatrix} \sin\{\omega(T2+T1)/2\} & \cos\{\omega(T2+T1)/2\} \\ \sin\{\omega(T3+T2+2T1)/2\} & \cos\{\omega(T3+T2+2T1)/2\} \end{bmatrix} \begin{bmatrix} A\cos\alpha \\ A\sin\alpha \end{bmatrix} = \omega \begin{bmatrix} \{\pi-\omega(T2+T1)\}/2\sin\{\omega(T2+T1)/2\} \\ \{\pi-\omega(T3+T2)\}/2\sin\{\omega(T3+T2)/2\} \end{bmatrix}$$

IMAGE FORMING APPARATUS INCLUDING A PHASE ADJUSTING UNIT FOR ADJUSTING THE PHASE OF ROTATIONAL FLUCTUATION OF IMAGE CARRIERS AND METHOD FOR CONTROLLING THE SAME

CROSS-REFERENCE TO RELATED APPLICATIONS

The present document incorporates by reference the entire contents of Japanese priority document, 2005-265663 filed in Japan on Sep. 13, 2005.

BACKGROUND OF THE INVENTION

1. Field of the Invention

The present invention relates to a technology for superimposing a plurality of different single-color images to obtain a color image.

2. Description of the Related Art

An image forming apparatus, in which a latent image is written on a photoconductor serving as an image carrier by an optical beam such as a laser beam, visualized by a developing device, and transferred onto a recording medium such as transfer paper, is widely used for a copier, a printer, a facsimile machine, a multifunction product, and the like. A color image forming apparatus capable of color image processing is in widespread use in response to growing market demand. As the color image forming apparatus, a so-called tandem type color image forming apparatus is widely used because high-speed image forming can be easily achieved. In the tandem type color image forming apparatus, a plurality of photoconductors each including a developing device are arranged in parallel, and single-color toner images formed on the respective photoconductors are sequentially transferred onto transfer paper to form a full-color image thereon.

In the color image forming apparatus, at the time of superimposing colors, color unevenness sometimes occurs in an image due to deviation of a color-superimposing position from a target position. Such a deviation is caused by, for example, rotational fluctuation generated cyclically for each one rotation of the photoconductors. The rotational fluctuation is corrected by a method in which a rotation detector including four slits is arranged on a shaft of the photoconductor, and a reference clock cycle of a motor serving as a rotation drive source for the photoconductor is adjusted to remove a fluctuation component. However, the rotational fluctuation of the photoconductor cannot be sufficiently removed by the method, thereby causing out-of-color registration.

For example, Japanese Patent Application Laid-Open No. 2002-268315 discloses an imaging device, in which one encoder is coupled with a plurality of photoconductors to detect fluctuations in one rotation of the respective photoconductors to adjust phases of the rotational fluctuation. Japanese Patent Application Laid-Open No. H9-127755 discloses a color image forming device, in which an encoder is attached to a photoconductor for a reference color, and rotational fluctuation of a photoconductor motor is detected based on an output signal from the encoder and deviation between resist marks transferred onto a transfer member as toner images.

In the imaging device, however, because of the belt-coupling, it is difficult to accurately detect fluctuations in one rotation cycle by the encoder due to environmental changes or belt characteristics. In addition, the respective photoconductors are coupled with one encoder, and therefore, the mechanism is complicated and large.

In the color image forming device, rotational fluctuation of the transfer member appears in between the resist marks of toner images. Therefore, it is difficult to accurately detect fluctuation of the photoconductor. When belt transfer is used, the fluctuation is also affected by belt expansion and contraction.

SUMMARY OF THE INVENTION

It is an object of the present invention to at least partially solve the problems in the conventional technology.

According to an aspect of the present invention, an image forming apparatus includes a plurality of image carriers, a driving unit that rotationally drives the image carriers in an individual manner, and a phase adjusting unit that adjusts, based on a reference rotation position on one of the image carriers, phase of rotational fluctuation of the other image carrier per one rotation.

According to another aspect of the present invention, a method for controlling an image forming apparatus, includes rotationally-driving a plurality of image carriers in an individual manner, setting a reference rotation position on one of the image carriers, and adjusting, based on the reference rotation position, phase of rotational fluctuation of the other image carrier per one rotation.

According to still another aspect of the present invention, an image forming apparatus includes a plurality of image carrier means, driving means for rotationally driving the image carrier means in an individual manner, and phase adjusting means for adjusting, based on a reference rotation position on one of the image carrier means, phase of rotational fluctuation of the other image carrier means per one rotation.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10 is an equation for calculating a fluctuation waveform corresponding to estimated one rotation of the photosensitive drum.

DETAILED DESCRIPTION OF THE PREFERRED EMBODIMENTS

Figure 1:
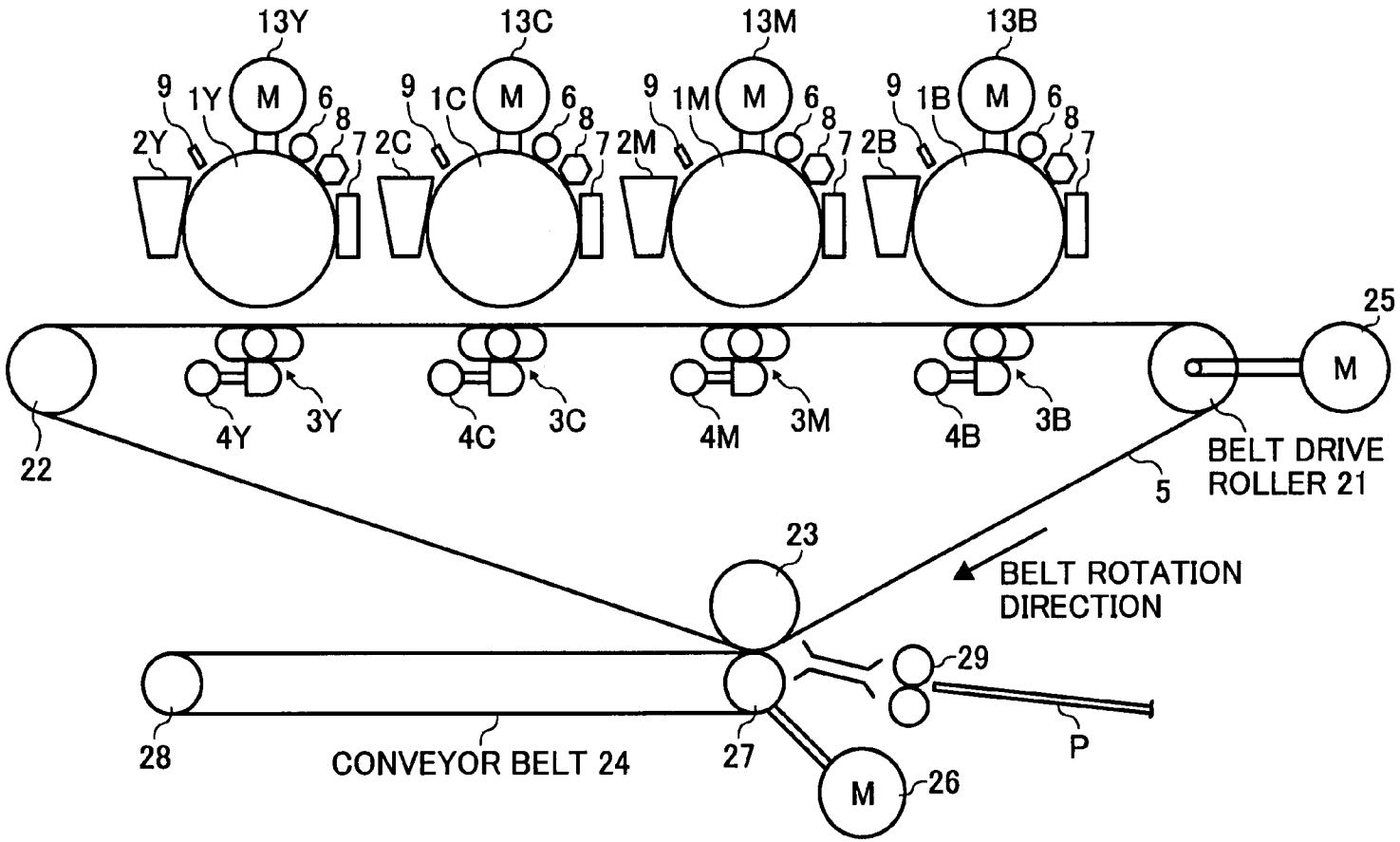
FIG. 1 is a schematic of one example of a tandem type image forming apparatus of an indirect transfer system.

Exemplary embodiments of the present invention will be explained below. In the following description, like reference numerals or letters refer to corresponding parts throughout the drawings, and the similar description is not repeated.

FIG. 1 is a schematic of one example of a tandem type image forming apparatus of an indirect transfer system. In the tandem type image forming apparatus, an endless intermediate transfer belt 5 is spanned over three rollers of a drive roller 21, a driven roller 22, and a support roller 23, and is rotatable in a clockwise direction in FIG. 1. The drive roller 21 is rotationally driven by a drive motor 25. Four image forming units each forming a single-color image of yellow (Y), cyan (C), magenta (M), or black (K) on the intermediate transfer belt 5 spanned between the drive roller 21 and the driven roller 22 are arranged along a conveying direction of the intermediate transfer belt 5. The image forming unit for yellow includes a photosensitive drum 1Y, a developing device 2Y, a transfer roller 3Y which is a transfer device, a charger 6, a cleaning device 7, a charge-remover 8, and a laser write unit 9 that are arranged about the photosensitive drum 1Y. The photosensitive drum 1Y is rotationally driven by a pulse motor 13Y. The transfer roller 3Y can be moved vertically by activating a separating and approximating mechanism 4Y to contact with and separate from the intermediate transfer belt 5.

After being evenly charged by the charger 6, a surface of the photosensitive drum 1Y is exposed with a laser beam corresponding to a yellow image by the laser write unit 9 to be formed with an electrostatic latent image. The formed electrostatic latent image is developed by the developing device 2Y, so that a toner image is formed on the photosensitive drum 1Y. The toner image is transferred onto the intermediate transfer belt 5 at a position (transfer position) in which the photosensitive drum 1Y and the intermediate transfer belt 5 contact with each other by the transfer roller 3Y to form a single-color image of yellow on the intermediate transfer belt 5. After the transfer is finished, unnecessary toner remaining on the surface of the photosensitive drum 1Y is removed by the cleaning device 7 to prepare for a next image formation.

A second image forming unit forms a magenta image on the intermediate transfer belt 5 thus transferred with a single-color (yellow) in a first image forming unit. The second image forming unit also includes a photosensitive drum 1M, a developing device 2M, a transfer roller 3M which is a transfer device, the charger 6, the cleaning device 7, the charge-remover 8, and the laser write unit 9 that are arranged about the photosensitive drum 1M like the first image forming unit. A magenta toner image formed on the photosensitive drum 1M is transferred onto the intermediate transfer belt 5 in superimposition with the yellow image as in the yellow image formation.

Thereafter, toner images formed similarly in a third image forming unit for cyan C and a fourth image forming unit for black B are transferred onto the intermediate transfer belt 5. Thus, a full color image is formed. The third and fourth image forming units have a configuration similar to that of the first and second image forming units. Therefore, a letter representing each color, for example, C for cyan and B for black, is attached to reference numerals denoting respective constituents, and detailed explanation for all these constituents is omitted. When color is not specified, the photosensitive drums and the developing devices are simply represented as photosensitive drums 1 and developing devices 2, respectively. A single-color toner image is formed on each photosensitive drum 1, a composite full-color image is formed by sequentially transferring the single-color toner images on the intermediate transfer belt 5 by contacting the toner images with the intermediate transfer belt 5, and the full-color image is collectively transferred onto a sheet of transfer paper P.

An endless conveyor belt 24 is spanned between a drive roller 27 rotationally driven by a motor 26 and a driven roller 28 on an opposite side of the intermediate transfer belt 5 from the four image forming units. The conveyor belt 24 is arranged to be pressed on the support roller 23 via the intermediate transfer belt 5 so that an image on the intermediate transfer belt 5 is transferred onto transfer paper P on the conveyor belt 24. A registration roller pair 29 rotates in time with the composite color image on the intermediate transfer belt 5 to feed the transfer paper P in between the intermediate transfer belt 5 and the conveyor belt 24.

Figure 2:
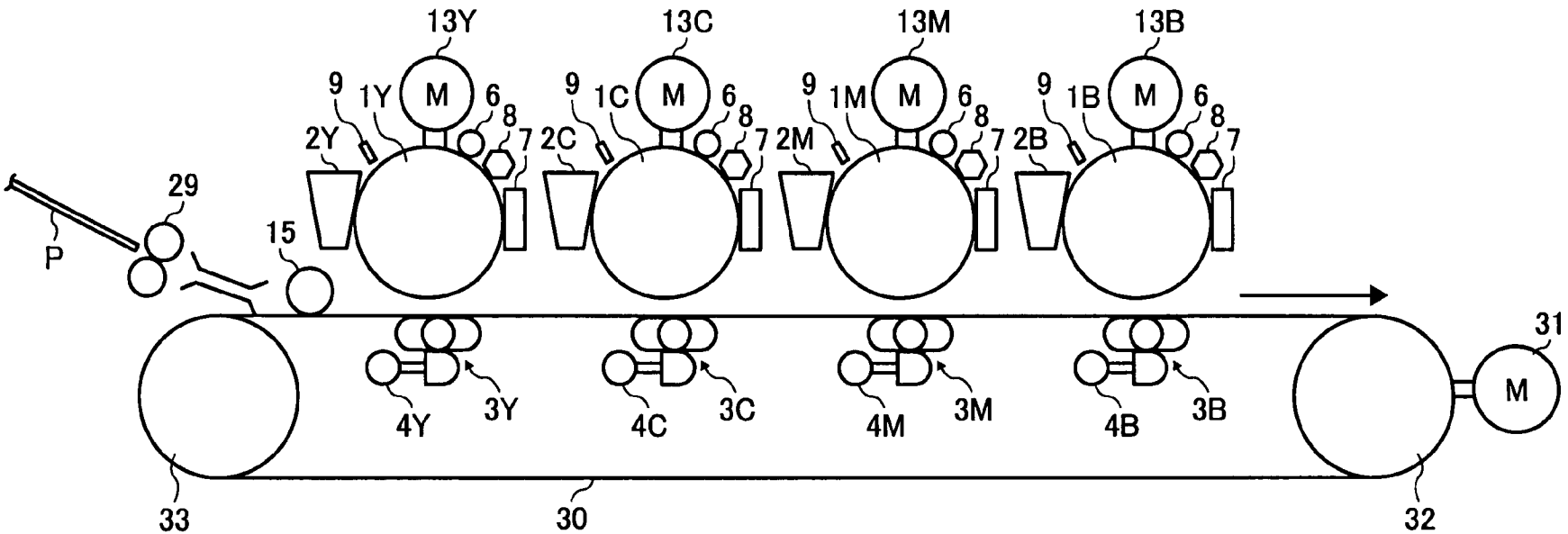
FIG. 2 is a schematic of one example of a tandem type image forming apparatus of a direct transfer system.

Besides the tandem type image forming apparatus of the indirect transfer system, a tandem type image forming apparatus of a direct transfer system has been proposed, which directly transfers images on the photosensitive drums 1Y, 1C, 1M, and 1B to the transfer paper P. FIG. 2 is a schematic of one example of the tandem type image forming apparatus of the direct transfer system.

Four image forming units for yellow, cyan, magenta, and black are of the same configuration as those in the image forming apparatus of the indirect transfer system described above. A transfer-conveyor belt 30 is spanned between a drive roller 32 and a driven roller 33 below the four image forming units, and rotationally driven in a clockwise direction in FIG. 2. The drive roller 32 is rotationally driven by a conveying-drive motor 31. The transfer rollers 3Y, 3C, 3M, and 3B are opposed to the photosensitive drums 1Y, 1C, 1M, and 1B in the respective image forming units via the transfer-conveyor belt 30.

In the tandem type image forming apparatus of the direct transfer system, sheets of transfer paper P are supplied one by one from the registration roller pair 29, and each sheet of transfer paper P is fed onto the transfer-conveyor belt 30 at appropriate timing by a timing roller 15. An image of yellow Y is first formed on the transfer paper P, and images of cyan C, magenta M, and black B are then superimposed on the image of yellow Y.

Figure 3:
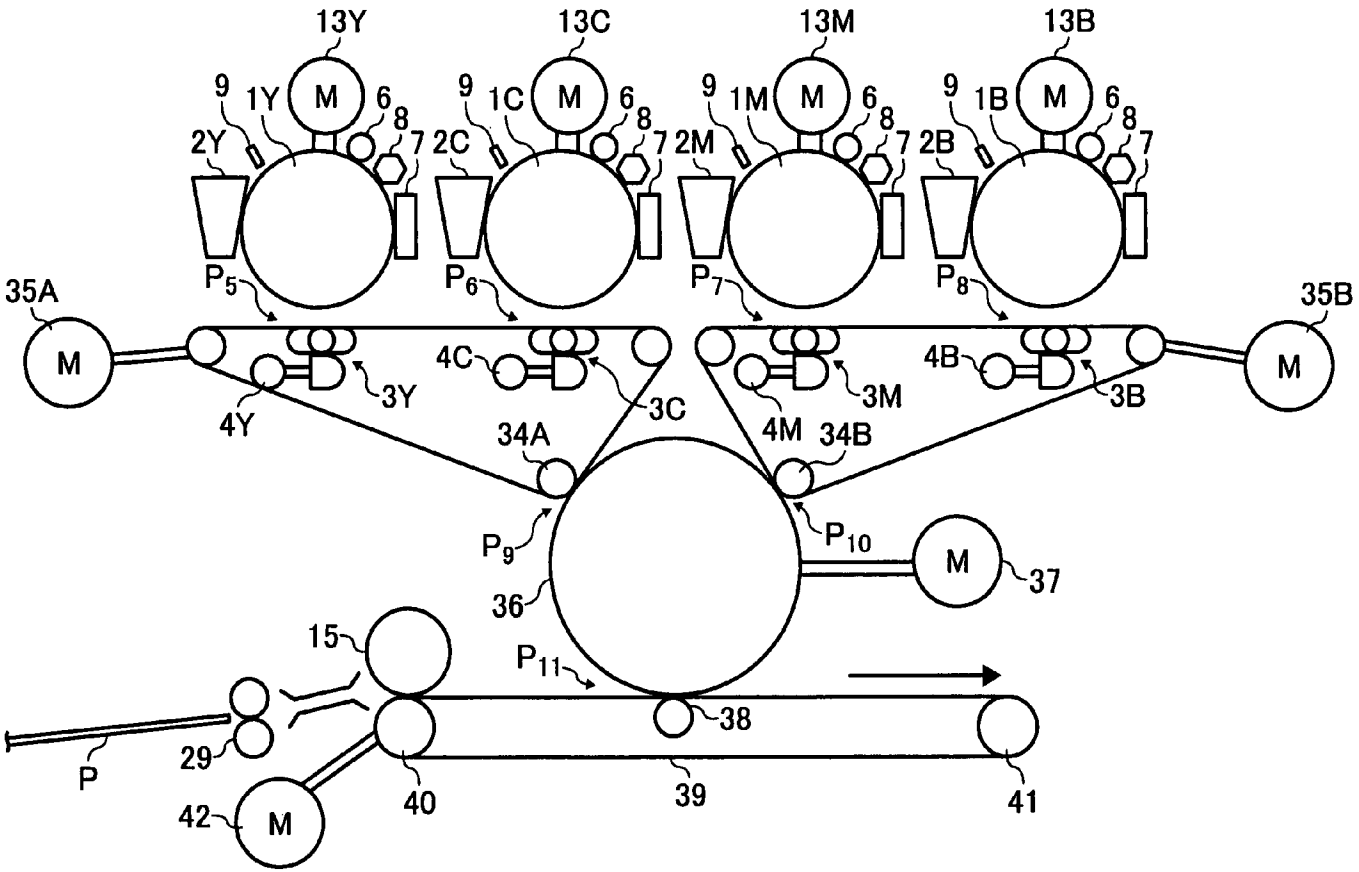
FIG. 3 is a schematic of one example of a tandem type image forming apparatus of an intermediate transfer system.

Besides the image forming apparatuses of the indirect transfer system and the direct transfer system described above, a tandem type image forming apparatus of another system has been proposed, in which the intermediate transfer member is divided into two members. FIG. 3 is a schematic of one example of a tandem type image forming apparatus of an intermediate transfer system.

In the image forming apparatus of this system, four image forming units for yellow, cyan, magenta, and black are also of the same configuration as those in the image forming apparatus of the indirect transfer system described above. The image forming apparatus of this type includes two first intermediate transfer members 34A and 34B that rotate independently from each other. Respective images formed on two photosensitive drums 1Y and 1C of four photosensitive drums 1Y, 1C, 1M, and 1B in the image forming units are transferred onto the first intermediate transfer member 34A at first transfer positions P5 and P6 in superimposition with each other. Respective images formed on the remaining two photosensitive drums 1M and 1B are transferred onto the first intermediate transfer member 34B at first transfer positions P7 and P8 in superimposition with each other. The first intermediate transfer members 34A and 34B are rotationally driven by first intermediate transfer motors 35A and 35B. Single-color toner images are formed on the respective photosensitive drums 1, and, by activating contacting and separating mechanisms 4 so that the transfer rollers 3 contacts the first intermediate transfer members 34, sequentially transferred onto the first intermediate transfer members 34.

The image forming apparatus includes a drum-like second intermediate transfer member 36, onto which respective images transferred onto the two first intermediate transfer members 34A and 34B are superimposed one another and transferred at second transfer positions P9 and P10, and the second intermediate transfer member 36 is driven by a second intermediate transfer motor 37. The image forming apparatus also includes a transfer roller 38 that transfers an image, transferred onto the second intermediate transfer member 36, onto transfer paper P at a third transfer position P11, and a conveyor belt 39 that rotates in a direction of arrow in FIG. 3 and conveys the transfer paper P. The conveyor belt 39 is spanned between a drive roller 40 and a driven roller 41, and rotated in a clockwise direction in FIG. 3 (arrow direction) according to driving of the drive roller 40 by a drive motor 42.

Figure 4:
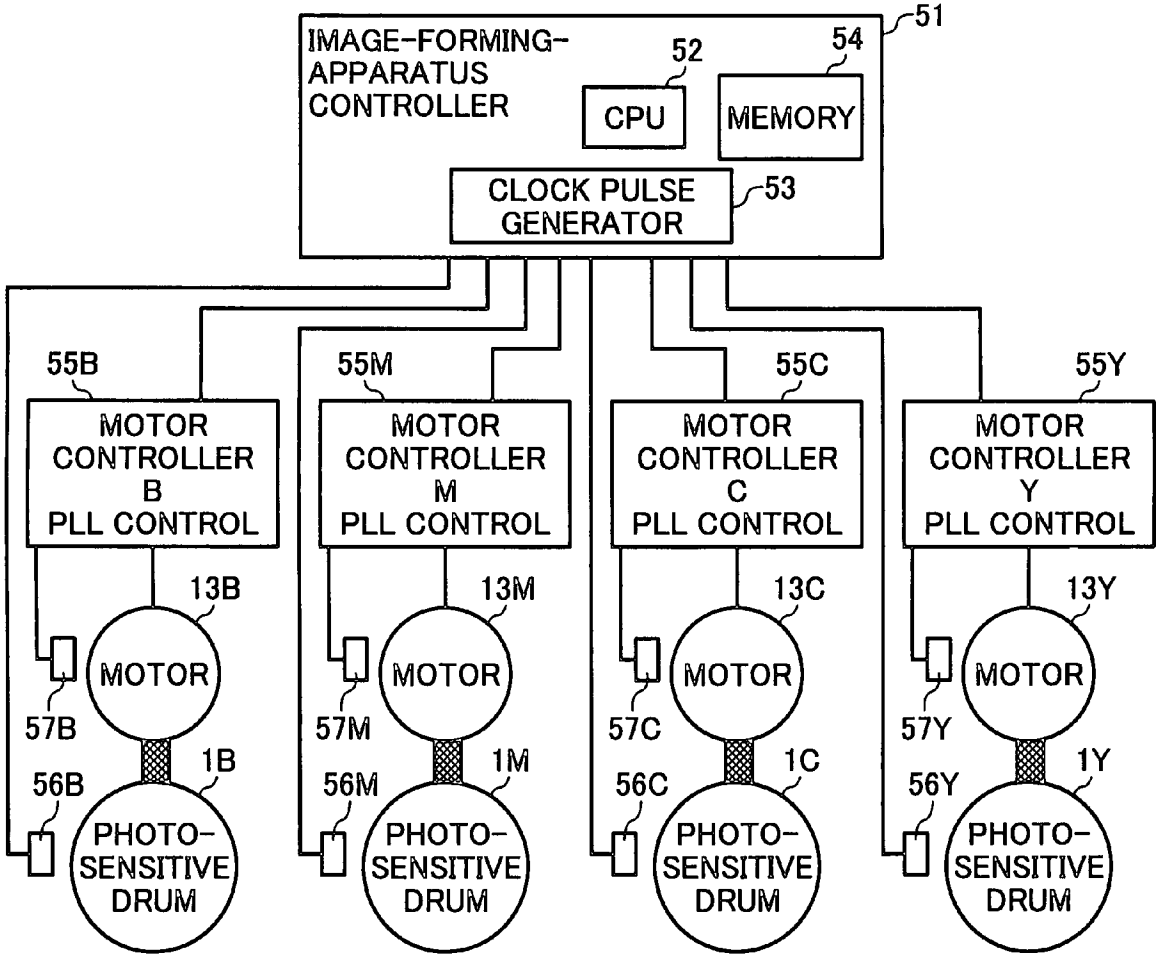
FIG. 4 is a block diagram for explaining motor control of image forming units in the image forming apparatuses shown in FIGS. 1, 2 and 3.

FIG. 4 is a block diagram for explaining motor control of the image forming units in the three systems described above. The image forming units in the three systems are the same and control circuits therein are the same. A configuration for motor control includes an image-forming-apparatus controller 51 having a central processing unit (CPU) 52 that performs the entire control for image formation, a memory 54 in which various setting conditions and the like are stored, a clock pulse generator 53 that generates clock pulses, and the like, and motor controllers 55Y, 55C, 55M, and 55B that control motors 13Y, 13C, 13M, and 13B of the respective photosensitive drums 1Y, 1C, 1M, and 1B. The image-forming-apparatus controller 51 and the motor controllers 55Y, 55C, 55M, and 55B are respectively connected with at least start and stop signals, reference phase locked loop (PLL) clock pulses that are speed signals, and rotation direction signals to the motors 13Y, 13C, 13M, and 13B, a power source, and the ground. Therefore, it is possible to set rotation speeds of the motors 13Y, 13C, 13M, and 13B individually to rotationally drive the motors at different speeds, respectively. The respective motors 13Y, 13C, 13M, and 13B are connected to the respective photosensitive drums 1Y, 1C, 1M, and 1B via gears to be transmitted with rotational drive. FSP sensors 56Y, 56C, 56M, and 56B as rotation detectors are placed on respective center shafts of the photosensitive drums 1Y, 1C, 1M, and 1B. Encoders 57Y, 57C, 57M, and 57B are arranged on respective motor shafts of the motors 13Y, 13C, 13M, and 13B, so that PLL control is performed based on outputs of the encoders.

Figure 5:
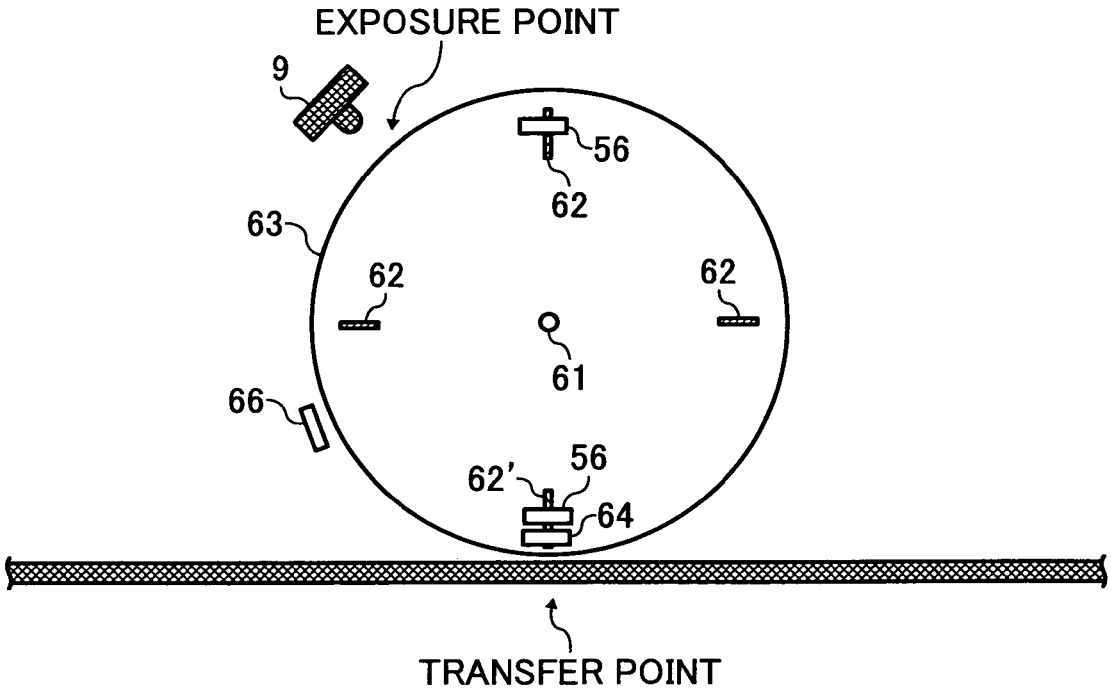
FIG. 5 is a front view of a rotation detector shown in FIG. 4.

FIG. 5 is a front view of the rotation detector 56. Since the respective image forming units have the same configuration, symbols representing the colors are not attached behind the reference numerals in the explanation. A shaft 61 of the photosensitive drum 1 is coaxially attached to a rotation plate 63 rotating integrally with the shaft 61. Four slits 62 are formed in an outer periphery of the rotation plate 63 at equal intervals, and the rotation detector (FSP sensor) 56 including a photosensor is arranged to face the slits 62 of the rotation plate 63. As described above, the rotation detector 56 is arranged to face the slits 62 at intervals of 180 degrees. Thus, the rotation detector 56 outputs four pulses for each one rotation of the photosensitive drum 1. A home position sensor 64 is set at a transfer position, and a slit positioned to face the home position sensor 64 at a start time serves as a home position slit 62'.

Figure 6:
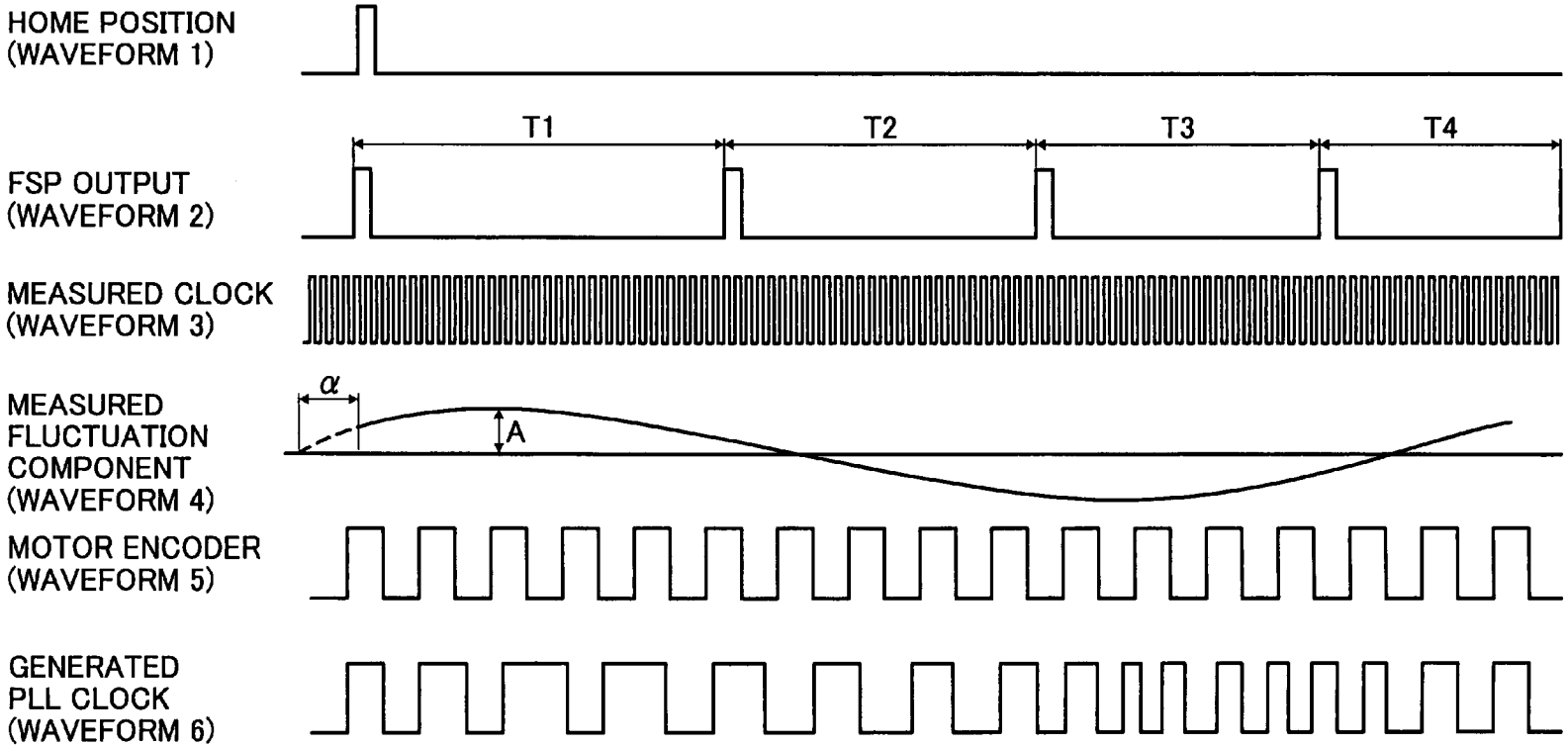
FIG. 6 is a timing chart for explaining reference clock generation and motor drive for PLL motor control.

FIG. 6 is a timing chart for explaining reference clock generation and motor drive relating to PLL motor control. A target PLL reference clock is output from the clock pulse generator 53 to the motor controller 55 in FIG. 4 to drive the motor 13. Pulse intervals T1, T2, T3, and T4 of an FSP output (waveform 2) are time-measured from a home (waveform 1) position of the rotation plate 63 of the rotation detector 56 based on measurement clocks (waveform 3) to obtain the intervals T1, T2, and T3 (waveform 2). Next, an amplitude A and an initial phase α (waveform 4), i.e., fluctuation components corresponding to one rotation of the photosensitive drum 1, are derived from an equation shown in FIG. 10 to calculate a fluctuation waveform corresponding to one estimated rotation of the photosensitive drum.

The amplitude A and the initial phase α are obtained from the equation shown in FIG. 10 in the following manner. When respective matrices in the equation shown in FIG. 10 are represented as B, X, and Y from the left, the matrix X is obtained by finding the inverse of the matrix B with equation (1) as follows:

$$X=B-1Y \tag{1}$$

The obtained matrix X is rearranged by equation (2) as follows:

$$X=\begin{pmatrix} S \\ C \end{pmatrix} \tag{2}$$

Then, the amplitude A and the initial phase α can be obtained with equations (3) and (4), respectively, as follows:

$$A=\sqrt{S^2+C^2} \tag{3}$$

$$\alpha=\tan^{-1}(C/S) \tag{4}$$

Thus, the amplitude A and the initial phase α, i.e., fluctuation components corresponding to one rotation cycle of the photosensitive drum 1, can be obtained.

Reference PLL clocks (waveform 6) are generated to offset the calculated fluctuation components and pulse widths thereof can be stored in the memory 54 in the order from the home position. Next, the generated reference PLL clock is output to perform PLL control together with a signal (waveform 5) of the encoder 57 at the motor shaft, thereby rotationally driving the motor 13. Rotational fluctuation of the photosensitive drum 1 is calculated and written in the memory at the time of out-of-color registration measurement or at the time of factory shipment. The measurement at the time of factory shipment is stored in a non-volatile memory.

Figure 7:
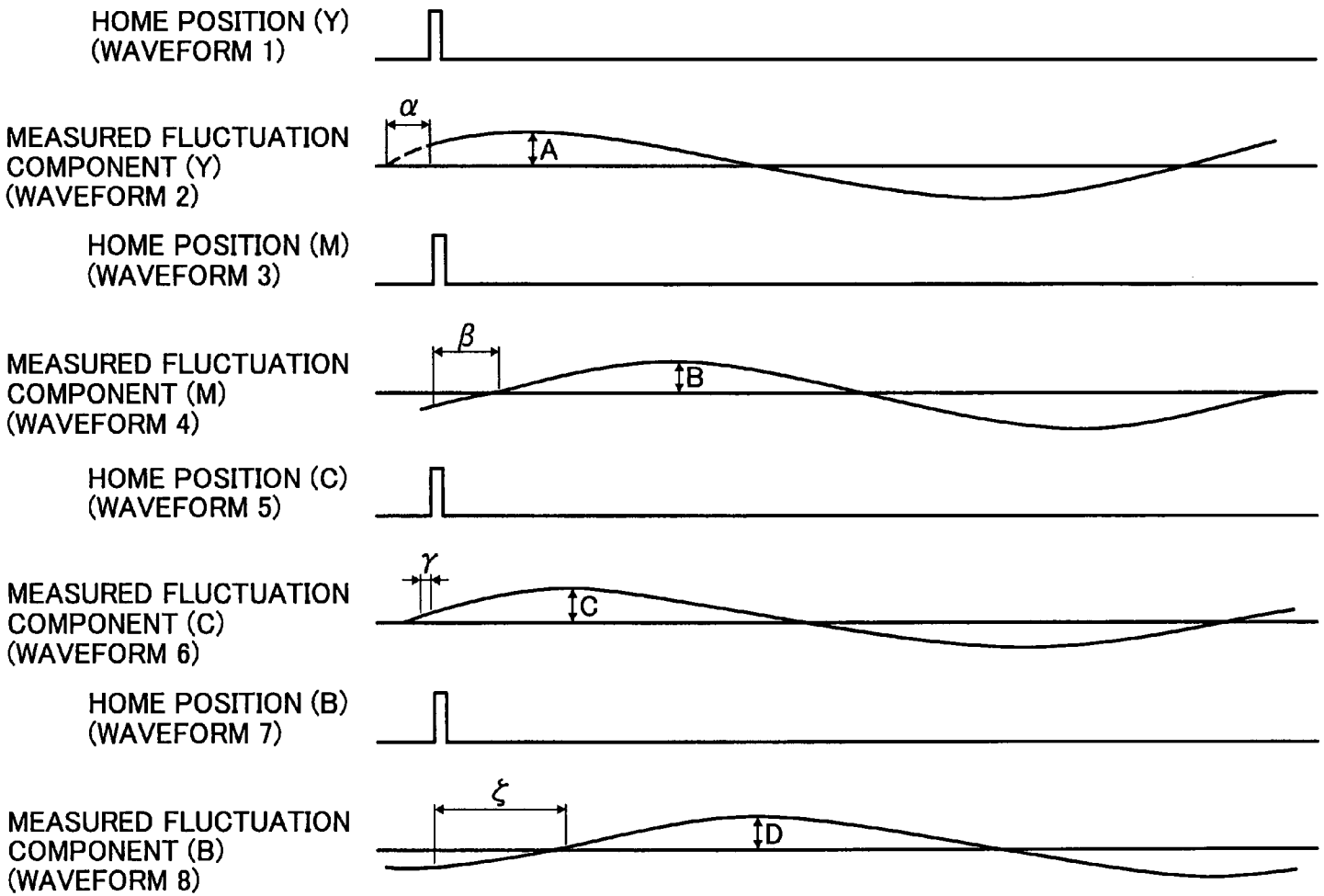
FIG. 7 depicts rotational fluctuations in one cycle components of four photosensitive drums shown in FIG. 4 with respect to the PLL motor control thereto.

A waveform diagram in FIG. 7 depicts fluctuations in one cycle components of the respective photosensitive drums 1Y, 1C, 1M, and 1B regarding PLL motor control thereto. As explained above, reference clock pulses are generated to offset fluctuation components of the respective photosensitive drums 1Y, 1C, 1M, and 1B and motor rotation start signals are controlled to make phases (α, 62 , γ, and ζ) of fluctuations corresponding to one cycle components of the respective photosensitive drums 1Y, 1C, 1M, and 1B match with one another.

Figure 8:
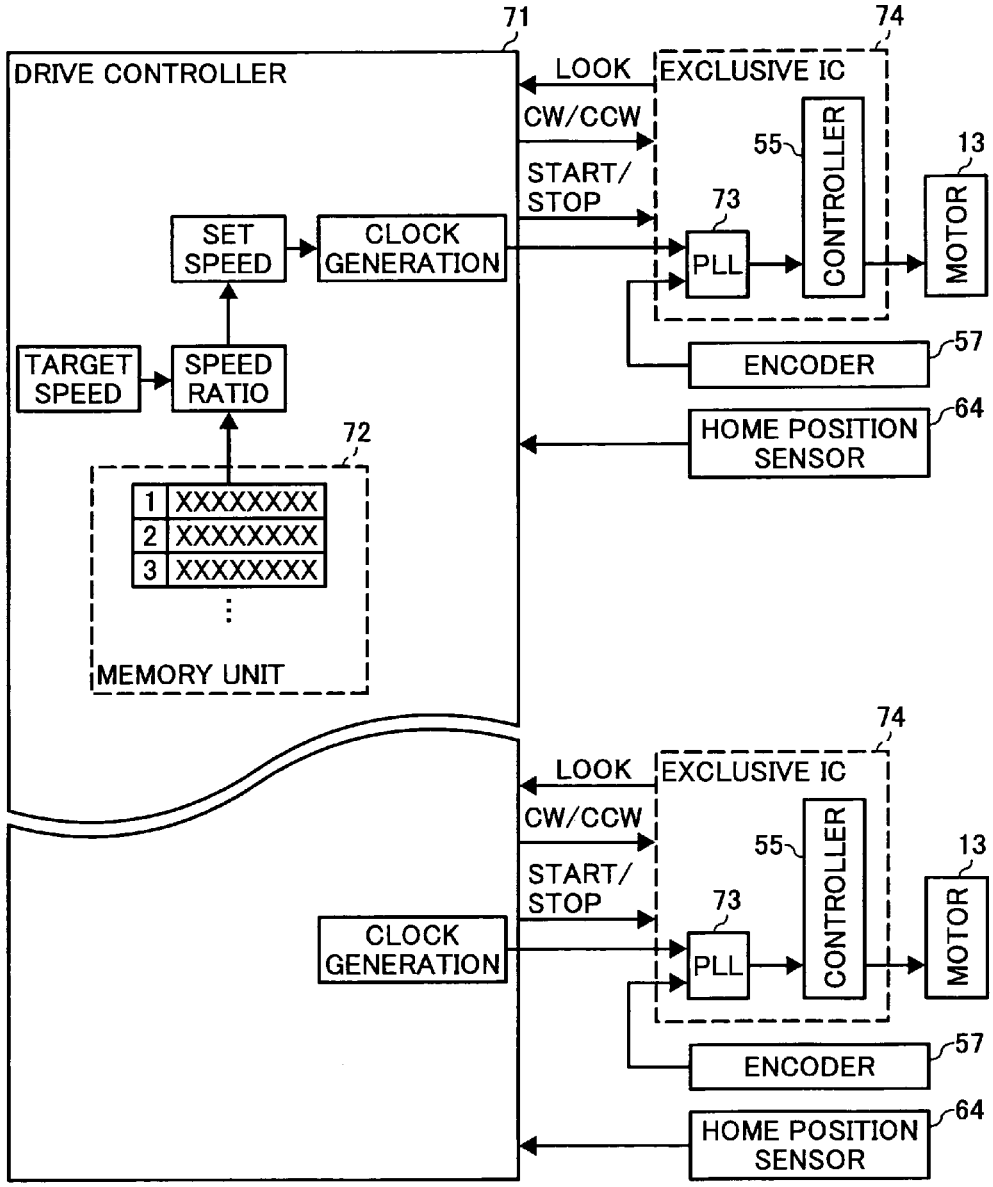
FIG. 8 is a block diagram of a drive controller.

FIG. 8 is a block diagram of a drive controller 71 that performs phase matching of the motors for the respective photosensitive drums 1Y, 1C, 1M, and 1B, and speed variable controlling. The drive controller 71 includes a memory unit 72, and sets a target speed, determines a speed ratio for achieving the target speed, determines a set speed based on the speed ratio, and generates clock pulses. The generated clock pulses are applied to PLL circuits 73 for respective colors. The PLL circuit 73 is adjusted by an output from the encoder 57 and an output thereof is applied to the motor controller 55. The PLL circuit 73 and the motor controller 55 are collectively arranged in an exclusive integrated circuit (IC) 74.

For example, when phases of the photosensitive drums 1C, 1M, and 1B for respective colors are matched to one another based on the photosensitive drum 1Y for Y color, rotation speeds of the photosensitive drums 1C, 1M, and 1B are adjusted so that phases of the photosensitive drums 1C, 1M, and 1B match the phase of the photosensitive drum 1Y. Thus, the phases of the four photosensitive drums 1Y, 1C, 1M, and 1B match one another. When the four phases match one another, a clock is generated from data stored in the memory unit 72 and the generated clock is output. When the motor controllers 55Y, 55C, 55M, and 55B of the respective photosensitive drums 1Y, 1C, 1M, and 1B output LOCK signals from the PLL circuits 73, image formation becomes possible.

Time that elapses with rotation from an exposure point at which each of the photosensitive drums 1Y, 1C, 1M, and 1B is exposed to a transfer point is calculated by a measurement sensor 66, whose output varies according to adhering toner between the exposure point and the transfer point on optical design, and calculating the time taken from exposure through development to sensor output from the PLL reference clock width stored in the memory unit 72. Because the time elapsing from the position of the measurement sensor 66 to the transfer point is calculated based on design, the time from the exposure point to the transfer point can be determined consequently. However, high precision in an attaching position of the measurement sensor 66 and high sensor precision are required.

Phase matching in the embodiment is performed at the time of correcting out-of-color registration. That is, the out-of-color registration can be reduced by adjusting the rotation speeds of the photosensitive drums 1Y, 1C, 1M, and 1B for respective colors such that the time, from an exposure point at which an image of each color is exposed to a transfer point at which the image is transferred, is the same for respective colors. Regarding rotation target speeds of the photosensitive drums 1Y, 1C, 1M, and 1B, speed ratios are defined by the set target speeds, and clock widths multiplied by the speed ratios are obtained when reference PLL clock width data stored in the memory unit 72 is read to obtain speed set values.

Figure 9A:
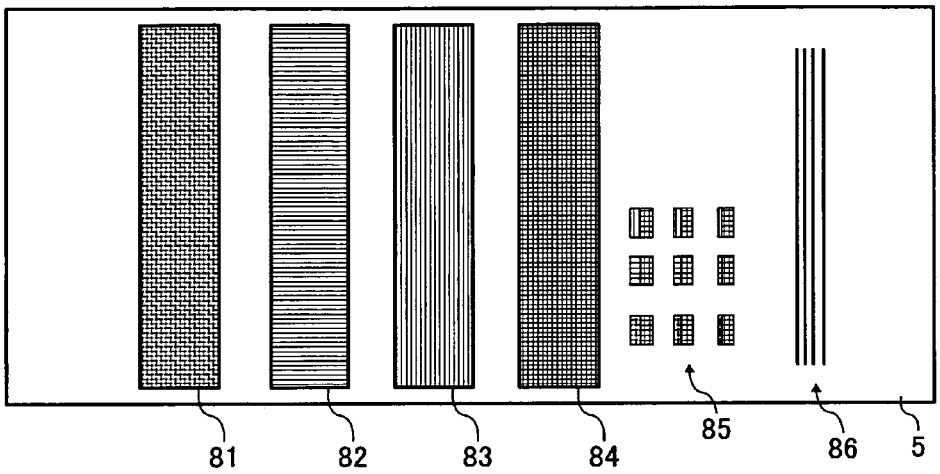
FIG. 9A is a plan view of one example of a detection pattern for detecting out-of-color registration.
Figure 9B:
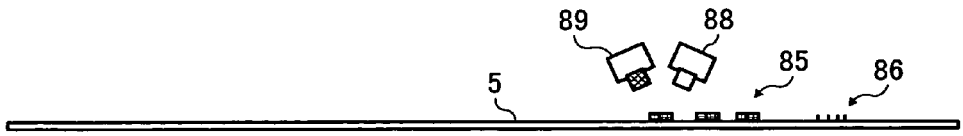
FIG. 9B is a side view of the detection pattern for explaining one example of a detecting mechanism thereof.

FIG. 9A is a plan view of one example of a detection pattern for detecting out-of-color registration performed in the tandem type image forming apparatus. FIG. 9B is a side view of one example of the detection pattern for explaining a detecting mechanism therefor. In the case of FIG. 1, patterns for detecting out-of-color registration (position deviation) are transferred onto the intermediate transfer belt 5 at stations for respective colors: a yellow station 81, a cyan station 82, a magenta station 83, and a black station 84. For example, in the case of a first detection pattern 85, a pattern is formed by superimposing yellow Y, cyan C, and magenta M on one another based on black B while changing a superimposition amount of these colors. The pattern is irradiated with light from a light source 88 such as a laser emitting diode (LED) or a laser diode (LD) to detect reflected light with a photosensor 89. With the detected amount, deviation amounts from target positions of respective colors are calculated.

When a second detection pattern 86 is used, predetermined lines extending in a main scanning direction are transferred on belts for respective colors. The lines on the intermediate transfer belt 5 are irradiated with light from the light source 88. The photosensor 89 detects reflected light, and calculates a deviation amount of the line from a target position. Therefore, a light reflection type sensor is used herein.

As a method for detecting the out-of-color registration (position deviation), there is also a method that uses a color charge coupled device (CCD) to detect out-of-color registration (position deviation) of respective colors from red, green, and blue (RGB) output results of the color CCD. In either case, phase matching is performed simultaneously at the time of such out-of-color registration detection or at the time of correction.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising, a plurality of image carriers;

a driving unit that rotationally drives each of the plurality of image carriers in an individual manner; and a phase adjusting unit that adjusts, based on a reference rotation position on one of the image carriers, phase of rotational fluctuation of the other image carrier per one rotation, the phase adjusting unit including, a rotation plate that is arranged coaxially with each of the image carriers, and rotates integrally with the image carrier, a plurality of to-be-detected portions that are arranged on the rotation plate at predetermined intervals in a circle with respect to a rotation axis of the rotation plate, a plurality of detectors that detect the to-be-detected portions, and output a signal, a controller that obtains a rotational fluctuation component caused by one rotation of the image carrier based on the signal output from the detector, a clock generator that generates a reference clock to offset the rotational fluctuation component, and a drive controller that controls the driving unit to rotationally drive the image carrier based on the reference clock, and the reference rotation position is set at one of the to-be-detected portions.

2. The image forming apparatus according to claim 1, wherein four to-be-detected portions are arranged on the rotation plate at intervals of 90 degrees, and two detectors are arranged relative to the to-be-detected portions at intervals of 180 degrees.

3. The image forming apparatus according to claim 1, wherein the image carriers each include a sensor that measures a time from an exposure point at which an image is exposed to a transfer point at which a developed image is transferred, and the drive controller adjusts a reference speed for the driving unit such that the time from the exposure point to the transfer point is the same in all the image carriers.

4. The image forming apparatus according to claim 3, wherein the drive controller adjusts the reference speed when correcting out-of-color registration.

5. The image forming apparatus according to claim 1, further comprising an intermediate transfer member onto which latent images on the image carriers are sequentially transferred to form a superimposed image, wherein the superimposed image is transferred onto a recording medium.

6. The image forming apparatus according to claim 1, further comprising a conveying member that conveys a recording medium, wherein images on the image carriers are sequentially transferred onto the recording medium conveyed by the conveying member.

7. The image forming apparatus according to claim 1, further comprising:

a first intermediate transfer member onto which images on any number of the image carriers are transferred;

a second intermediate transfer member onto which images on the remaining image carriers are transferred; and a third intermediate transfer member onto which images on the first intermediate transfer member and the second intermediate transfer member are sequentially transferred to form a superimposed image, wherein the superimposed image is transferred onto a recording medium.

8. A method for controlling an image forming apparatus, comprising:

arranging one of a plurality of rotation plates coaxially with each of a plurality of image carriers such that the rotation plate rotates integrally with the image carrier;

arranging a plurality of to-be-detected portions on the rotation plate at predetermined intervals in a circle with respect to a rotation axis of the rotation plate;

setting a reference rotation position on one of the image carriers at one of the to-be-detected portions;

rotationally-driving each of the plurality of image carriers in an individual manner;

detecting the to-be-detected portions to output a signal;

obtaining a rotational fluctuation component caused by one rotation of the image carrier based on the signal;

generating a reference clock to offset the rotational fluctuation component, and adjusting, based on the reference rotation position, phase of rotational fluctuation of the other image carrier per one rotation, wherein the rotationailly-driving includes rotationally-driving each of the plurality of image carriers based on the reference clock.

* * * * *